US006978489B1

(12) United States Patent
Chao et al.

(10) Patent No.: US 6,978,489 B1
(45) Date of Patent: Dec. 27, 2005

(54) TOILET SEAT

(76) Inventors: Yu-Lan Chao, PMB#1008, 1867 Ygnacio Valley Rd., Walnut Creek, CA (US) 94598; Littlee, PMB#1008, 1867 Ygnacio Valley Rd., Walnut Creek, CA (US) 94598

( * ) Notice: Subject to any disclaimer, the term of this patent is extended or adjusted under 35 U.S.C. 154(b) by 0 days.

(21) Appl. No.: 10/878,439

(22) Filed: Jun. 29, 2004

(51) Int. Cl.[7] ..... A47K 13/10
(52) U.S. Cl. ..... 4/246.2
(58) Field of Search ..... 4/246.1–246.2

(56) References Cited

U.S. PATENT DOCUMENTS 5,138,724 A * 8/1992 Chien et al. ..... 4/241
5,435,017 A * 7/1995 Pan ..... 4/246.2
5,461,734 A * 10/1995 Faircloth ..... 4/246.1
6,470,502 B2 * 10/2002 Lu ..... 4/246.1
6,684,416 B1 * 2/2004 Chao et al. ..... 4/246.2

* cited by examiner

*Primary Examiner*—Charles E. Phillips
(74) *Attorney, Agent, or Firm*—Leong C. Lei

(57) ABSTRACT

A toilet seat allowing a smooth lift up of the seat comprises a seat cover and a seat; two accommodation troughs on both sides of the seat and pivoted to the toilet; two boxes each divided into three compartments connecting through one another and containing a bypass trough; an air vent being provided between two troughs to balance pressure; a gap being provided on the partition in a V-shape between the second and the third compartments; and an inclined board further extending from the V-shaped partition.

9 Claims, 9 Drawing Sheets

TOILET SEAT

BACKGROUND OF THE INVENTION (a) Technical Field of the Invention

The present invention is related to a construction of a toilet seat, and more particularly, to one that allows silent, gradual, steady lifting of the seat for sanitary purposes and which prevents malfunction of the lifting.

(b) Description of the Prior Art

On average, one has to go to the bathroom six up to ten times. However, toilet seats generally available in the market are not designed with an automated lift up mechanism. Residual urine on the seat may result if the male user does not urinate accurately or does not lift up the seat before urination, which can be inconvenient and distasteful for the female user. Further problems include bacteria infection, skin diseases, discomfort, bad odors, and/or offensive appearance sight which could result in conflict between the two genders. As a result, there is now the improvement of a toilet cover that automatically lifts up. But the improvement usually operates via spring-load or hydraulic, meaning one has to hold down the seat before use and the seat lacks a deferred lift up function. Both the USA Patent Publication No. 096211, for a Fluid-based Time Automatic Lifting Toilet Seat and an ROC Patent Publication No. 276480, for an improved construction of a Fluid-based Time Automatic Lifting Toilet Seat Fixture, though teaching a silent and automatic lifting mechanism of the toilet seat, are found with the following defects according to the findings of hands-on installation by this inventor: (1) an inherited protrusion of the seat results once it is adapted to the toilet to prevent readjustment of the angle of the protrusion that constitutes a barrier in the installation of the seat in case of a larger cistern; (2) the lifting provided by weighted balance is controlled by the flow of the fluid, and an unsteady flow or uneven level of the ground often frustrates or even causes the failure of the lifting motion; (3) once the seat lifts up for approximately 45 degrees, a resistance is created which stops the lifting process, and the seat will no longer lift up if such resistance is not overcome; and (4) as the lifting mechanism operates on the liquid contained in a front and a rear compartment without any partition, the fluid in the rear compartment fails to completely flow back to the front one when the seat lifts up to 90 degrees and the backflow of the fluid to the rear compartment affects the motion and timing of the lifting.

Another improvement as taught in U.S. Pat. No. 6,684,416B1 for a construction of Automatic Lifting Toilet Seat does achieve improvements for those defects found with the constructions disclosed in the previously mentioned patent publications. All three patents share the common problem that, although the seat does slowly lift up, the lifting process starts immediately after the user has left the toilet seat and so the seat may hit the user, which shows that further improvement is warranted for the construction and arrangement of the members in the box containing liquid for the lifting mechanism.

SUMMARY OF THE INVENTION

The purpose of the present invention is to provide a toilet seat lifting mechanism that prevents failure in the lifting process. To achieve the purpose, the present invention comprises a seat cover, a seat, two accommodation troughs each provided on both sides to the rear of the seat and pivoted to the toilet; two boxes containing liquid being divided with partitions into multiple compartments, preferably into three compartments that connect through one another for the fluid to flow; and a bypass trough being fixed a preset location in the box characterized by an air vent being provided between two compartments to balance the pressure difference of the fluid among the compartments to make sure the liquid in one compartment is able to flow precisely into another compartment.

Another purpose of the present invention is to provide a toilet seat lifting mechanism that prevents the seat from directly hitting the user just leaving the toilet seat. To achieve the purpose, a gap trough keeping a preset distance from the bottom of the trough is provided on the partition erected between the second and the third compartments. Accordingly, the second compartment maintains a preset amount of water with the box in its horizontal status to cope with the pre-adjustment of the weight in the box, so that the seat first maintains a preset lifting angle before subsequent lifting slowly once the pressure exercised by the user on the seat disappears.

Yet another purpose of the present invention is to provide a toilet seat lifting mechanism that ensures a smooth lifting process of the seat. To achieve the purpose, the partition erected between the second and the third compartments provided with the gap trough is made in a V-shaped and further extending a slant board so to firmly and smoothly guide the fluid in the second compartment into the third compartments for ensuring a smooth lift of the seat.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
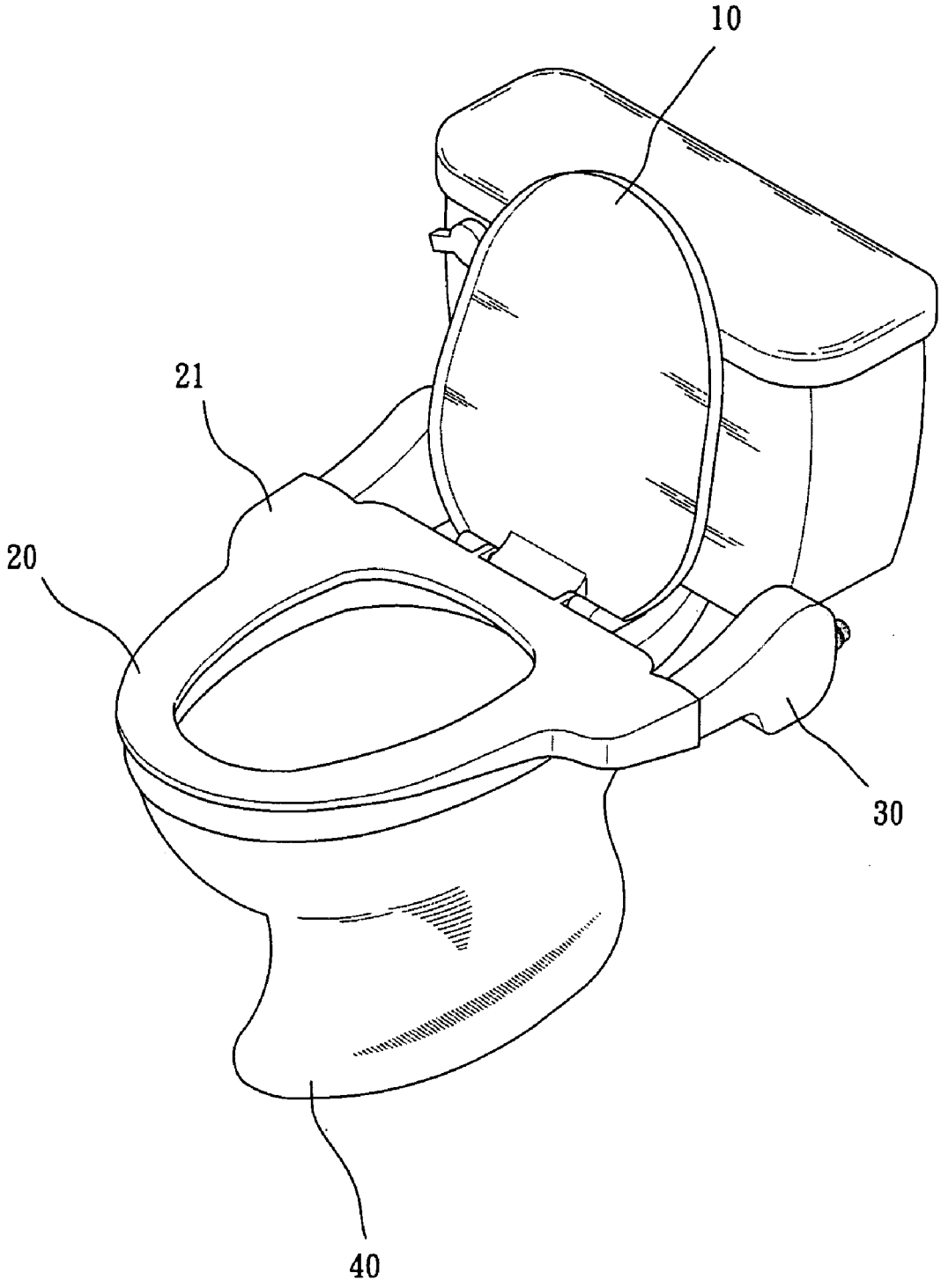
FIG. 1 is a schematic view showing the appearance of a preferred embodiment of the present invention.
Figure 2:
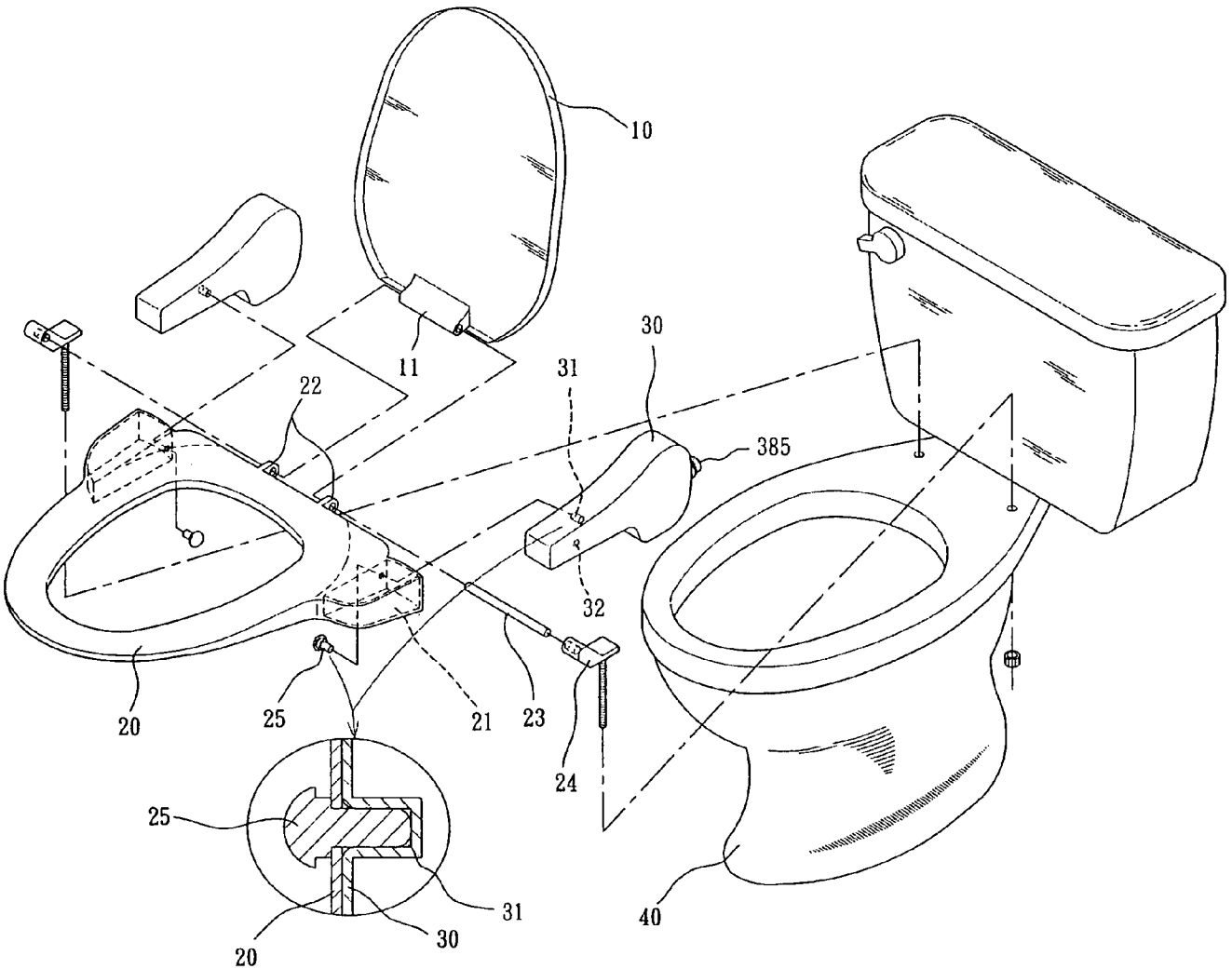
FIG. 2 is an exploded view of the preferred embodiment of the present invention.
Figure 3:
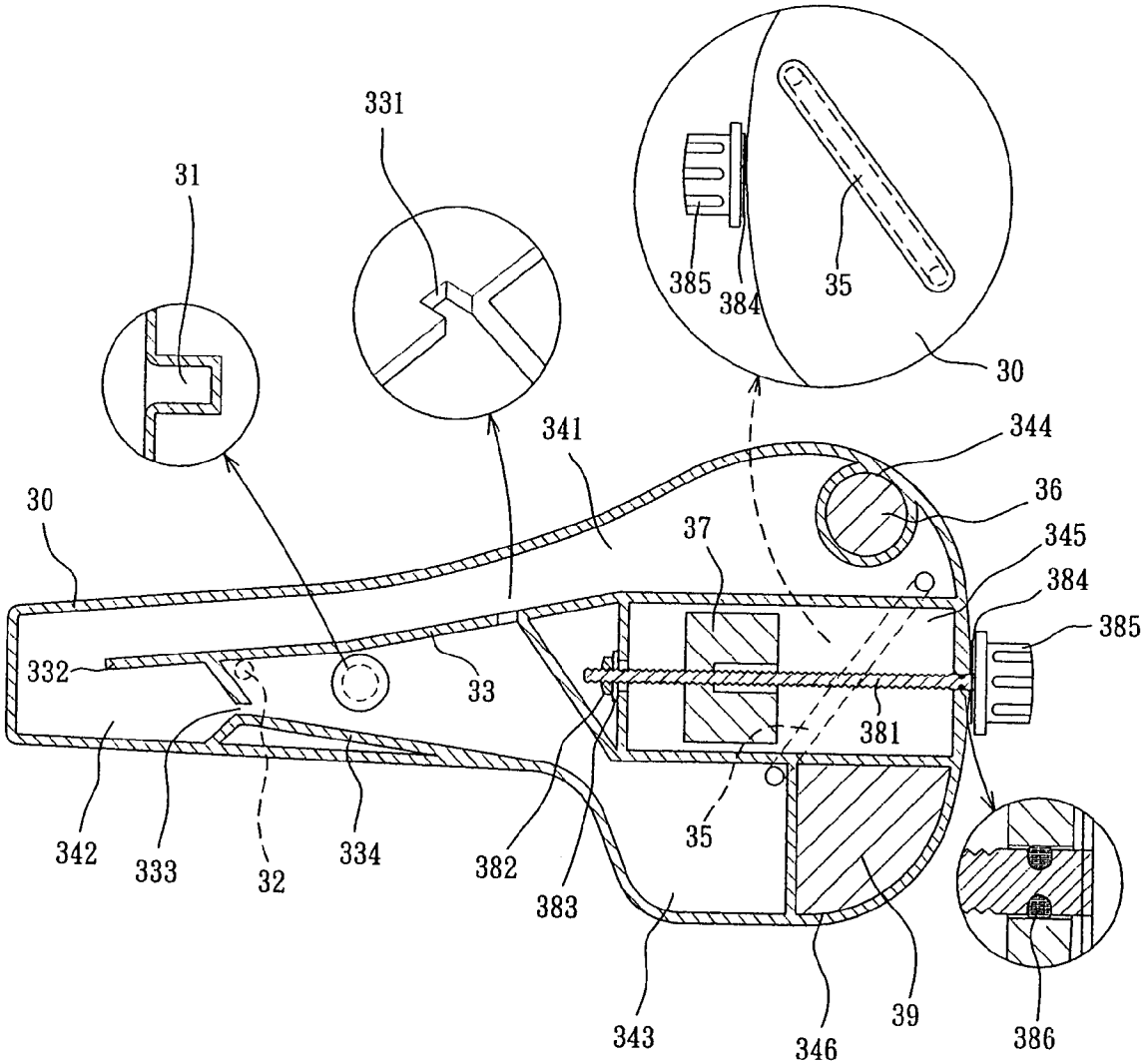
FIG. 3 is a sectional view showing the assembly status of a box allowing adjustment of the weight.
Figure 4:
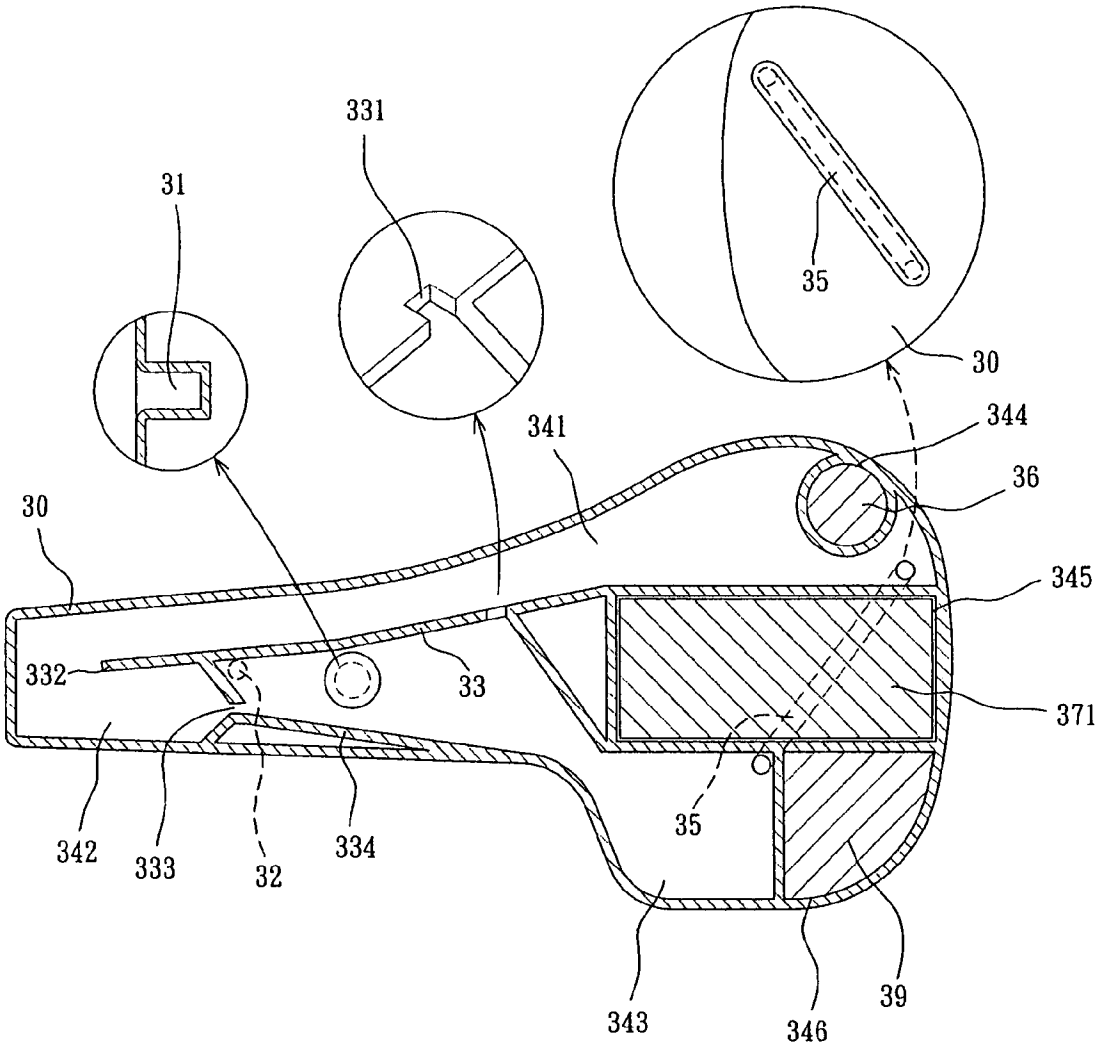
FIG. 4 is a sectional view showing the assembly status of a box not adapted with the weight adjustment device.

Referring to FIGS. 1, 2, and 3, a preferred embodiment of the present invention is essentially comprised of a toilet seat cover 10, a seat 20 pivoted to the cover and provided on a toilet bowl 40, two boxes 30 each containing flowing liquid, compartments and weight for the seat 20 to silently, smoothly and automatically lift up for sanity purposes once the user leaves the seat 20.

A seat holder 11 is provided to the seat cover 10. An accommodation trough 21 is each integrated with the seat cover 20 at the approximate ends on both sides of the seat cover 20 to a cistern of the toilet; an opening is disposed to the rear of the accommodation trough 21 to receive the placement of the box 30; two corresponding eyelets 22 are provided in the rear of the seat 20 to sandwich the holder 11 of the seat cover 10 so to allow a rod 23 to penetrate through both eyelets 22 and the holder 11 to pivot the seat cover 10 to the seat 20; and two fixation members 24 are each provided to both ends of the rod 23 to pivot both of the seat cover 10 and the seat 20 to the toilet bowl 40.

The box 30 in a size smaller than that of the accommodation trough 21 has on its top provided with a recessed hole 31 to allow a locking member 25 to penetrate through the wall of the accommodation trough 21 and further into the recessed hole 31 thus to secure the box 30 firmly in the accommodation trough 21; a water inlet 32 is provided on the box 30 to fill liquid such as water or other fluid into the box 30; the water inlet 32 may be sealed once the box 30 is filled up with the liquid. A partitioning frame 33 provided inside the box 30 roughly divides the interior of the box 30 into three compartments, respectively a first compartment 341, a second compartment 342, and a third compartment 343. Wherein, the first compartment 341 is connected through the second compartment 342; an air vent 33 is provided on the section of the partitioning frame 33 at where between the first compartment 341 and the third compartment 343 to balance the pressure difference among the compartments. A plate 332 extending from the partitioning frame 33 for a given length is disposed between the first compartment 341 and the second compartment 342 in the box 30 to ensure that the liquid in the rear of the first compartment 341 to completely flow into the second compartment in the front to avoid backflow, thus to maintain precise lifting motion and timing of the seat 20. The section of the partitioning frame 33 erected between the second compartment 342 and the third compartment 343 is provided with a gap trough 333 away from the bottom of the third compartment 343 for a given distance to allow the second compartment maintaining a preset amount of water with the box 30 in its horizontal status. The section of the partitioning frame 33 erected between the second compartment 342 and the third compartment 343 is made in a V-shaped to facilitate guiding the fluid to flow into the gap trough 333, and a slant board 334 extends from the lower edge of the gap trough 333 to consistently guide the fluid in the second compartment 342 into the third compartment. A bypass trough 35 connecting through the first compartment 341 and the third compartment 343 is provided on the surface of the box 30 for the liquid to flow back and forth between the first compartment 341 and the third compartment 343 while overcoming a resistance created when the seat 20 is lift up to an angle of approximately 45 degrees.

Figure 5A:
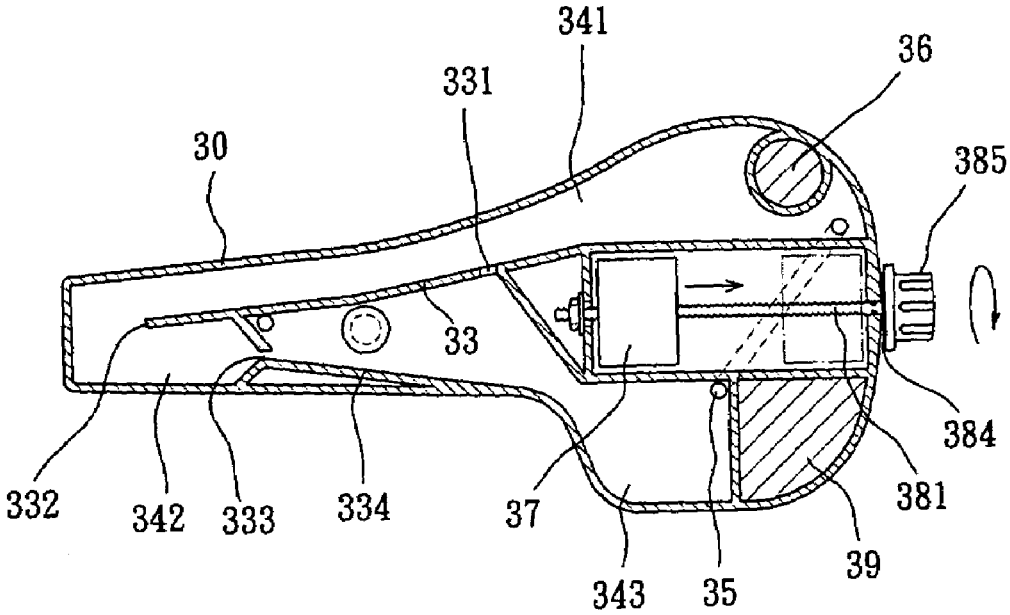
FIGS. 5A and 5B are schematic views showing the motion of the location of the adjustable weight of the preferred embodiment of the present invention.
Figure 5B:
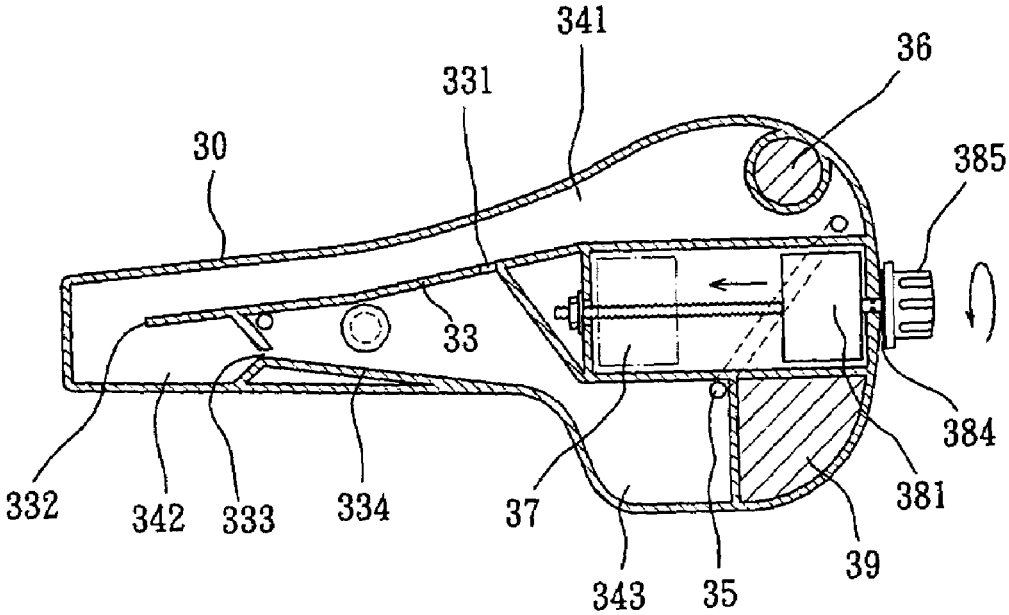

As illustrated in FIGS. 3, 5A and 5B, additional compartments 344, 345, and 346 are provided to the rear of one box 30 of the present invention for the placement respectively of a weight 36 in the compartment 346, another weight 39 in the compartment 344, or an adjustable weight 37 in the compartment 345 while all the weights 36, 39, and 371 placed in those additional compartments to the rear of another box 30 are fixed as illustrated in FIG. 3. The location of the weight 37 is adjustable by means of an adjustment. The adjustment is comprised of a worm gear 381 inserted through the weight 37. The end of the worm gear 381 penetrating through the wall of the compartment 345 is disposed with a nut 382 and a packing 383 while the other end of the worm gear 381 penetrating and exposed out of the box is attached with a resilient member 384 and a knob 385, and a washer 386 is provided to where the worm gear 381 penetrates. Accordingly, both ends of the worm gear 381 are restricted in position to facilitate turning the worm gear 381. Whereas both of the top and bottom of the weight 37 are made in flat, the weight 37 is able to slide easily by turning the adjustment knob 385 for completing a precise adjustment of the weight for the box 30. The travel of the movement of the weight 37 is made even smoother since the space of the compartment 345 is greater than that of the prior art to allow larger scope of adjustment.

Figure 6A:
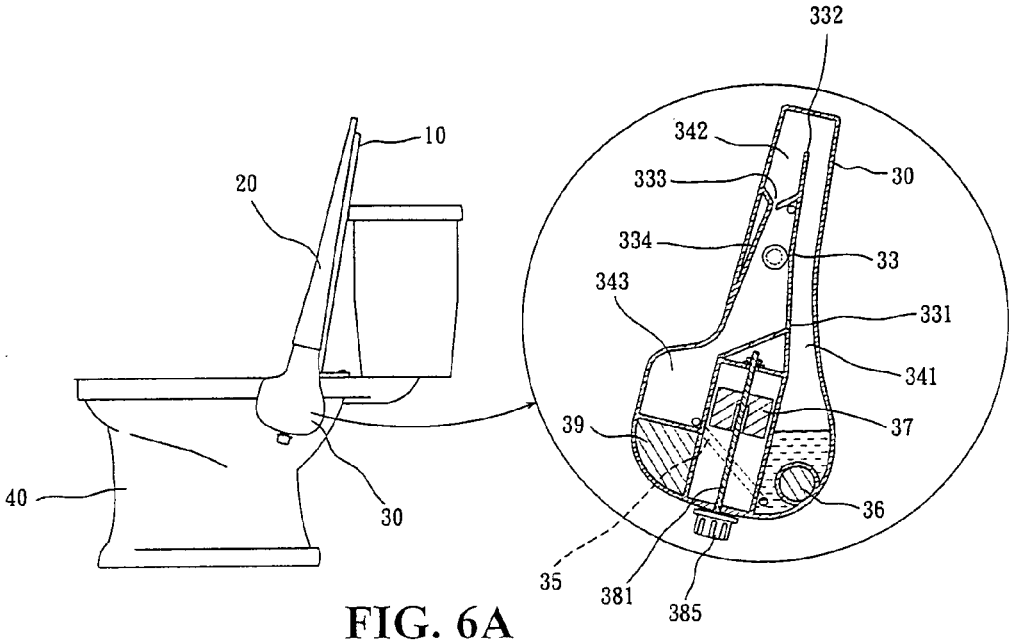
FIGS. 6A, 6B, 7A, 7B, 8A, 8B, 9A, and 9B are schematic views showing the deferred lifting process of the preferred embodiment of the present invention.

Now referring to FIG. 6A, the seat before the use of the toilet blow 40 is maintained in lifted up position on the toilet bowl 40 due to the weight in the box 30, wherein, the liquid is concentrated in the first compartment 341.

Figure 6B:
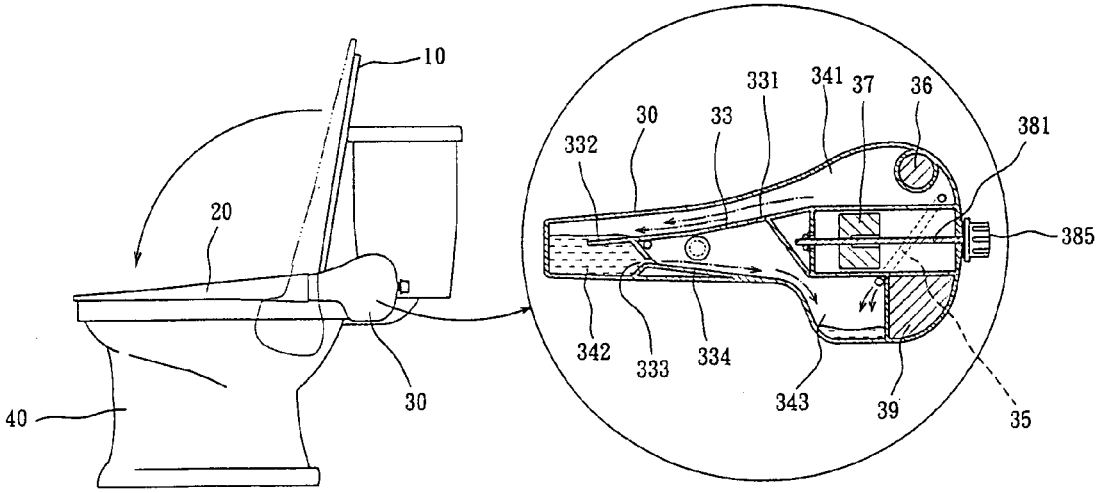

To use the toilet bowl 40, the seat 20 closes up on the toilet bowl 40 as illustrated in FIG. 6B, and the liquid in the box 30 automatically flows from the first compartment 341 into the second compartment 342, through the gap trough 333 into the third compartment 343. Meanwhile, the air vent 331 balances the pressure difference between the first compartment 341 and the third compartment 343 to avoid failure of the flow due to the interrupted flow to the liquid in the second compartment 342 and the bypass trough 35.

Figure 7A:
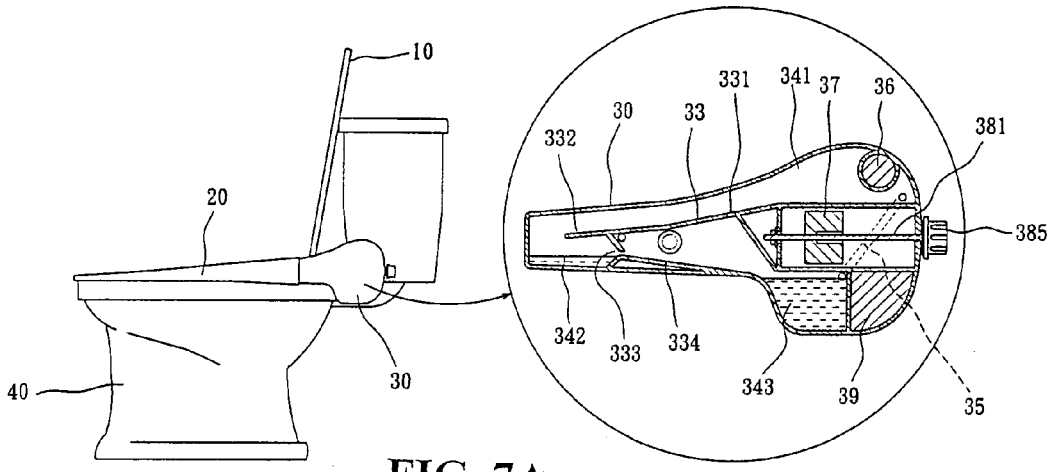

As illustrated in FIG. 7A, the seat 20 is prevented from being lifted up from the toilet bowl 40 due to the weight of the user and the function dominated by the weight of the liquid in the second compartment. The liquid follows the gap trough 333 to flow slowly into the third compartment 343. When the level of the liquid in the second compartment 342 drops to the lower edge of the gap trough 333, the second compartment 342 maintains a certain amount of the liquid since the gap tough 333 stays away from the bottom of the second compartment for a given distance for providing the deferred lift function to complete the first stage of balance.

Figure 7B:
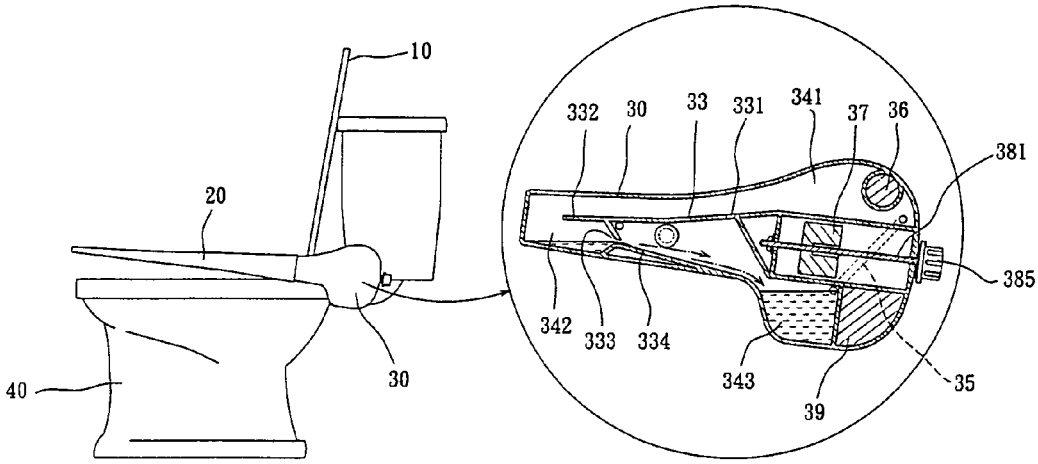

Referring to FIG. 7B, when the user leaves the seat 20, the seat maintains a preset lift angle first due to the relief of the weight of the user and the pre-adjustment made in the box 30 so to avoid direct contact of the user upon leaving the seat 20. Later, the residual liquid in the second compartment 342 flows once again along the slant board 334 into the third compartment 343. The seat 20 lifts up silently and automatically to its erect position due to the weight of the fluid. The plate 332 prevents the fluid in the second compartment 342 from flowing into the first compartment 341 in the rear while the seat 20 lifts up, to avoid backflow and make sure of the correct motion and timing of the lifting process executed by the seat 20.

The V-shaped section of the partitioning frame erected between the second compartment 342 and the third compartment 343 as illustrated in FIG. 8*e* facilitates the liquid to be collected and guided to the gap trough 333 when the box

30 indicates a lifting angle while the liquid in the second compartment 342 is guided with the slant board 334.

Figure 8A:
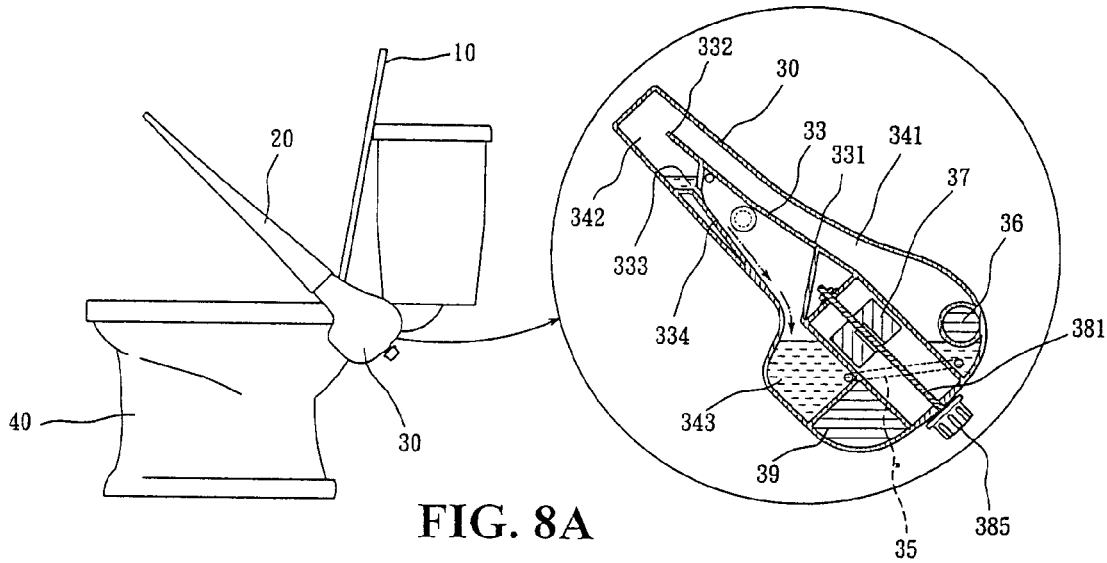
Figure 8B:
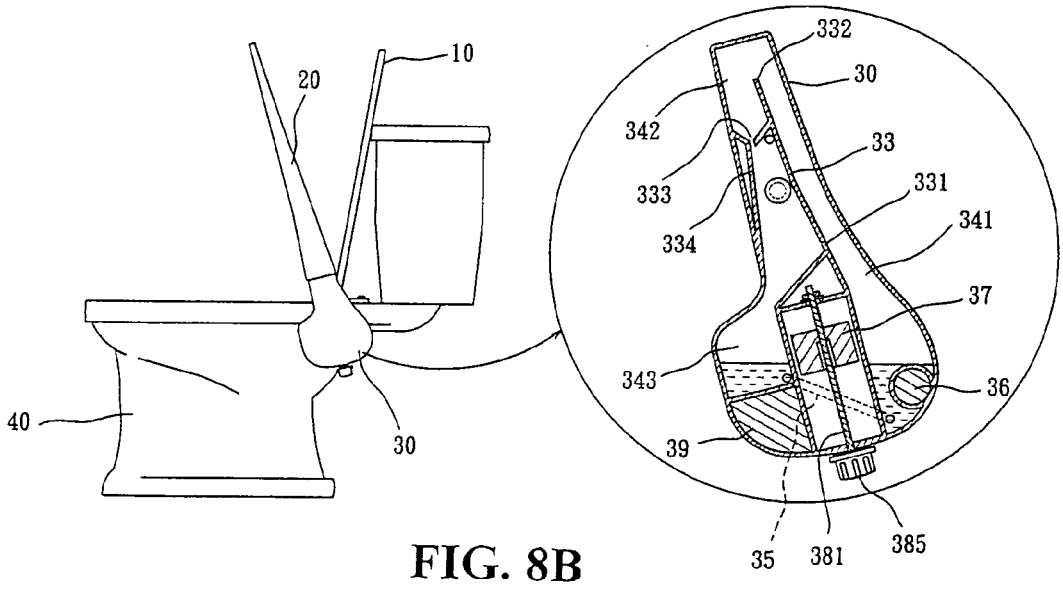
Figure 9A:
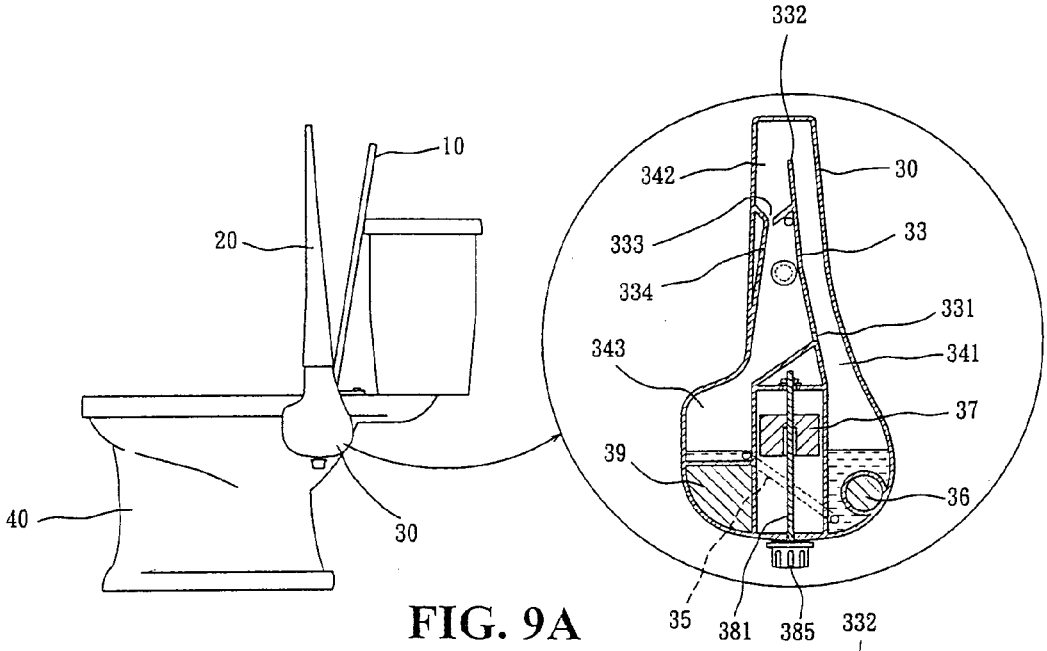
Figure 9B:
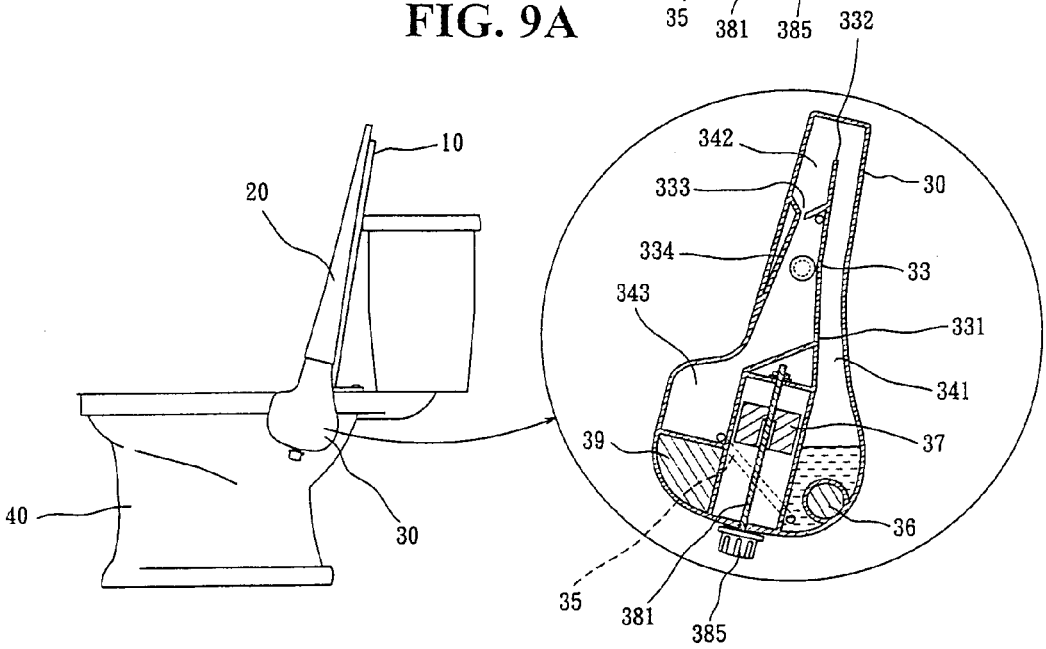

As illustrated in FIGS. 8A, 8B, and 9A, when the seat 20 is automatically lifted up to a certain position, the liquid in the third compartment 343 flows into the first compartment 341 in the rear by way of the bypass trough 35; meanwhile, the domination by the weight varies to overcome the resistance created (when the seat 20 is automatically lifted up to an angle approximately of 45 degrees to prevent the further lifting of the seat 20) from the lifting motion. Accordingly, the failure in a complete lifting motion of the seat 20 is prevented.

Now referring to FIG. 9*h*, after the liquid in the third compartment 343 has slowly and completely flown into the first compartment 341, the seat 20 completes a full cycle of automatic lifting. If any awkward lifting process is found with the seat 20, the adjustment knob 385 provided on the back of the box 30 allows a precise adjustment of the weight in the box 30 to be made, to make sure of smooth lifting motion of the cover 20.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

We claim:

1. A toilet seat provided with at least one accommodation trough, said seat being pivotally mounted on the rear of a toilet bowl, and at least one box containing liquid and a partitioning frame to divide the interior of the box into at least three compartments connected to one another for the liquid to flow therein, is characterized by: an air vent provided between a first and third compartments to balance the pressure difference therebetween, a gap trough positioned in a partition between a second and said third compartment away from the bottom of the second compartment for a given distance, when said bottom is situated horizontally while said seat is on said bowl, whereby said second compartment will maintain a preset amount of liquid therein such that, the seat will first maintain a present lifting angle before being further slowly and smoothly lifted to a vertical position by liquid movement once the pressure of the user on the seat is removed so as to avoid contact with a user of the seat.

2. A toilet seat as claimed in claim 1, wherein, a recessed hole is provided on top of the box and a locking member penetrates the wall of the accommodation trough and the recessed hole to firmly secure the box to the accommodation trough.

3. A toilet seat as claimed in claim 1, wherein, the section of the partitioning frame provided with the gap trough is made in a V shape.

4. A toilet seat as claimed in claim 1, wherein, a slant board extends from section of the partitioning frame provided with the gap trough at the lower edge of the gap trough.

5. A toilet seat as claimed in claim 1, wherein, the box contains multiple compartments each to be placed with a fixed or adjustable weight.

6. A toilet seat as claimed in claim 5, wherein, the adjustable weight has its location adjusted by an adjustment including a worm gear to penetrate the weight, one end of the worm gear penetrating and exposed out of the wall of the compartment is provided with a locking member and the other end penetrating and exposed out of the box is inserted with a resilient member and an adjustment knob.

7. A toilet seat as claimed in claim 6, wherein, a packing is provided where the worm gear penetrates.

8. A toilet seat as claimed in claim 1, wherein a bypass trough is provided on the surface of the box between the first and the third compartments.

9. A toilet seat as claimed in claim 1, wherein a plate is provided between the first and the second compartments.

* * * * *